US008342192B2

(12) United States Patent
Parker

(10) Patent No.: US 8,342,192 B2
(45) Date of Patent: Jan. 1, 2013

(54) COMPACT FOR LIQUID COSMETICS

(75) Inventor: Philippe Parker, St. Julians (MT)

(73) Assignee: Toly Products (UK) Ltd. (GB)

( * ) Notice: Subject to any disclaimer, the term of this patent is extended or adjusted under 35 U.S.C. 154(b) by 437 days.

(21) Appl. No.: 12/161,170

(22) PCT Filed: Jan. 11, 2007

(86) PCT No.: PCT/GB2007/000074

§ 371 (c)(1),
(2), (4) Date: Jul. 22, 2010

(87) PCT Pub. No.: WO2007/083086

PCT Pub. Date: Jul. 26, 2007

(65) Prior Publication Data

US 2010/0275948 A1 Nov. 4, 2010

(30) Foreign Application Priority Data

Jan. 20, 2006 (GB) ..... 0601192
Jul. 20, 2006 (GB) ..... 0614449

(51) Int. Cl.
*A45D 33/24* (2006.01)
*A45D 33/00* (2006.01)
*A45D 33/02* (2006.01)

(52) U.S. Cl. ..... 132/300; 132/293; 132/298

(58) Field of Classification Search ..... 132/293–299, 132/301, 306, 307, 314–317; 206/581, 823, 206/229

See application file for complete search history.

(56) References Cited

U.S. PATENT DOCUMENTS

| | | | | |
|---|---|---|---|---|
| 2,930,384 | A * | 3/1960 | Strain et al. | 132/205 |
| 3,199,743 | A | 8/1965 | Berger | |
| 4,343,397 | A | 8/1982 | Nozawa et al. | |
| 4,991,989 | A | 2/1991 | Fitjer | |
| 5,125,537 | A | 6/1992 | Slapin et al. | |
| 5,344,037 | A | 9/1994 | Favre | |
| 5,638,839 | A * | 6/1997 | Montoli | 132/295 |
| 5,906,214 | A * | 5/1999 | Gueret | 132/314 |
| 6,536,447 | B1 | 3/2003 | Fioravanti et al. | |
| 2004/0060890 | A1 * | 4/2004 | Van Parys | 215/12.1 |

FOREIGN PATENT DOCUMENTS

JP 2004208973 7/2004

OTHER PUBLICATIONS

Search Report dated May 11, 2006 in priority Application No. GB0601192.8.
Search Report dated Oct. 27, 2006 in priority Application No. GB0614449.7.

* cited by examiner

*Primary Examiner* — Nicholas Lucchesi
*Assistant Examiner* — Niyati D Shah
(74) *Attorney, Agent, or Firm* — Dean W. Russell; Kristin M. Crall; Kilpatrick Townsend & Stockton LLP

(57) ABSTRACT

A cosmetic compact (1) comprises a container (9) to hold liquid cosmetics, and a stopper (5) for to the compact (1). The stopper comprises a protrusion (7) that cooperates with a dispensing orifice (8) of the container. The stopper is connected by a hinge (6) to a lid (2) or base (3) of the compact, preferably to the lid. The stopper may thus serve as a latch for the lid of the compact. The hinged connection (6) may be a web integrally formed with the stopper and the adjacent part of the compact, or it may comprise a pin or protrusion.

10 Claims, 3 Drawing Sheets

COMPACT FOR LIQUID COSMETICS

CROSS REFERENCE TO RELATED APPLICATIONS

This application is the U.S. national phase of International Application No. PCT/GB2007/000074 filed on Jan. 11, 2007 and published in English on Jul. 26, 2007 as International Publication No. WO 2007/083086 A1, which application claims priority to Great Britain Application No. 0601192.8 filed on Jan. 20, 2006 and to Great Britain Patent Application No. 0614449.7 filed on Jul. 20, 2006, the contents of which are incorporated herein by reference.

FIELD OF INVENTION

The present invention relates to a container for dispensing liquid cosmetics. It particularly relates to a cosmetics compact which conveniently stores and dispenses the liquid cosmetic product. The compact may also store other items such as an applicator sponge or mirror.

BACKGROUND OF THE INVENTION

Most cosmetic compacts contain cosmetic materials in solid, paste or powder form. Compacts for applying more mobile liquid cosmetics are known, but can be cumbersome to use. It can be particularly inconvenient when the liquid cosmetic is stored in a container having a separate removable stopper or cap. This requires the user to set aside or separately hold the stopper when using the compact. This can be messy and inconvenient, as well as risking loss of the stopper.

JP2004208973 describes a cosmetic compact for dispensing a liquid cosmetic product without the need to remove a separate stopper from the liquid cosmetic container, thus reducing the possibility of staining a user's hands. The cosmetic compact comprises a main body having an inner lid, an outer lid and a base connected by a hinge. The base of the compact comprises a recess to contain a cosmetic puff and a further recess as a reservoir for dispensed liquid cosmetics. The liquid cosmetic product is supplied from a tubular container equipped with a pump-type dispenser. The outer lid is coupled with the inner lid so as to enclose the tubular container. A pushbutton of the pump type dispenser is exposed in an opening in the outer lid. On pressing the pushbutton, the liquid cosmetic product is dispensed into the reservoir recess, for uptake on the puff.

JP2004208975 describes an otherwise similar cosmetic compact in which the liquid cosmetic product is automatically dispensed from the tubular container into the reservoir when the lid is opened. Variants include a compact with a pump type dispenser having a nozzle for dispensing the liquid product directly onto a hand held sponge. The nozzle has a separate cover. In another variant, a squeeze-to-empty product container hinges out of the base of the compact and has a dispensing passageway leading to an uptake reservoir which also serves as a recess for storing a removable sponge.

Despite the advantages offered by JP2004208973 and JP2004208975 by removing the need for a separate stopper, the compacts shown are complex, having many components. Even manufacturing a container with a separate removable stopper for holding the liquid cosmetic product requires additional process steps compared to compacts for solid cosmetics or pastes. This represents an additional cost. Even small savings in the cost of manufacturing an individual compact are significant in mass production.

U.S. Pat. No. 4,343,397, JP2002336039 and U.S. Pat. No. 6,536,447 all concern compacts in which a container for a liquid cosmetic product is closed by a stopper integrated into the structure of the compact. However the disclosed compacts still leave room for improvement in terms of ease of manufacture and use.

The present applicant has realised that hingedly connecting the stopper of the liquid cosmetic container with the compact eliminates the disadvantages of having to remove and separately retain the stopper and can simplify the manufacturing process by limiting the number of components needed. Such a compact can also include an applicator sponge, puff, brush, mirror and/or other tools and accessories of the usual kind.

SUMMARY OF THE INVENTION

Accordingly, the present invention provides a cosmetic compact having a lid hingedly connected to a base, the compact further comprising a container to hold liquid cosmetics, and a stopper for the container connected to the lid or base, characterised in that the connection between the stopper and the lid or base comprises a further hinge.

The stopper may comprise a protrusion that cooperates with a dispensing orifice in the container.

The stopper is preferably connected to the lid. The stopper may also serve as a latch for the lid of the compact. The hinged connection may be a web integrally formed with the stopper and the adjacent part of the compact. Alternatively, the further hinge may comprise a pin or protrusion on one of the stopper or lid/base and which is journalled in the other of the stopper or lid/base.

The container may comprise a flexible wall which is accessible when a lid of the compact is opened. Thus the wall may be squeezed to dispense the liquid cosmetics product when the stopper is removed and the lid opened. A further flexible wall of the container may be accessible through an aperture in a base of the compact.

Further preferred features and aspects of the invention will be apparent from the dependent claims and the following description of an illustrative embodiment, made with reference to the accompanying drawings.

Figure 1:
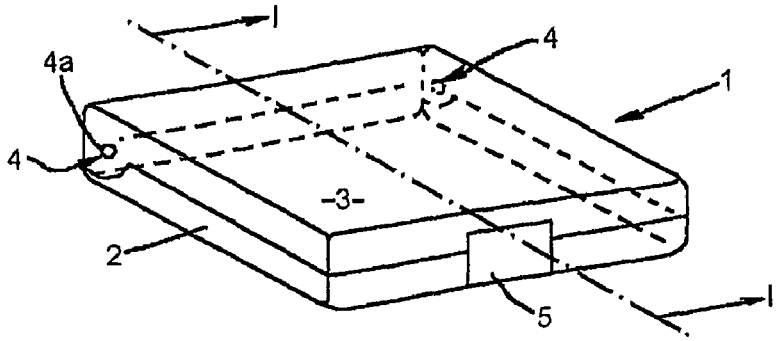
FIG. 1 is a schematic representation of a cosmetic compact embodying the invention, shown when the lid is closed.

The cosmetic compact 1 shown in FIG. 1 comprises a lid 2 and a base 3 connected by hinges 4. The hinges shown are held together by hinge pins 4*a*. The lid 2 further comprises a stopper 5, which also serves as means to latch the lid 2 closed against the base 3.

Figure 2:
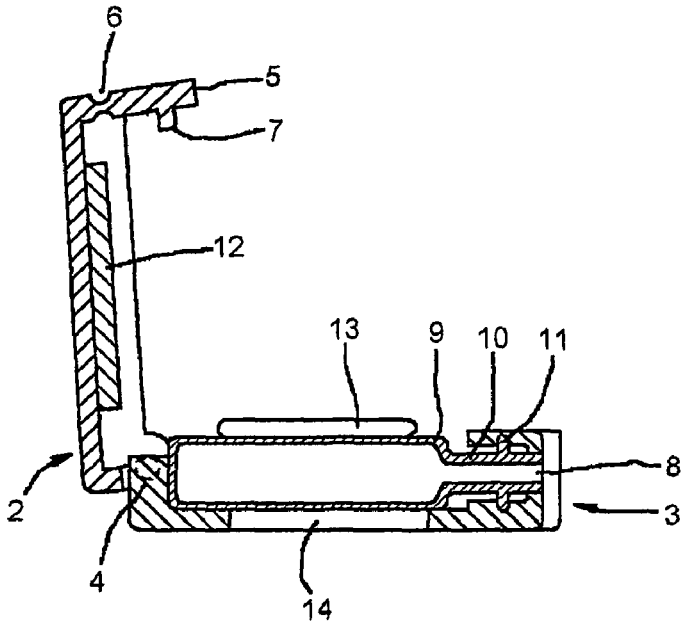
FIG. 2 is a schematic cross-section through the cosmetic compact along the line I-I, shown when the lid is open.
Figure 3:
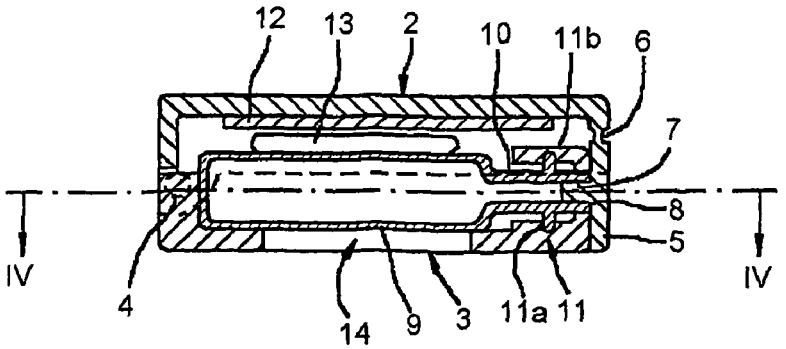
FIG. 3 is a schematic cross-section through the cosmetic compact along the line I-I, shown when the lid is closed.

FIGS. 2 and 3 show cross-sectional views of the cosmetic compact on line 1-1 in FIG. 1, with the lid 2 open and closed respectively. The stopper 5 is a flap connected to the lid 2 by a hinge 6. The hinge 6 is shown as a thin flexible web integrally formed with the lid 2. However, other means to connect the stopper 5 to the lid 2 by means of a hinge known in the art are permissible.

The stopper 5 comprises a protrusion 7 which cooperates with a dispensing orifice 8 of a tottle or other suitable squeeze-to-empty container 9 housed in the base 3 of the cosmetic compact 1. ("Tottle" is a term recognised in the packaging field, denoting a flexible walled container that may be regarded as a hybrid between a tube and bottle, hence the name). The protrusion 7 is shaped such that it either snugly fits into the orifice 8 in the front face of the cosmetic compact 1 or is inserted into and held in the orifice 8 by a snap-in arrangement.

Figure 4:
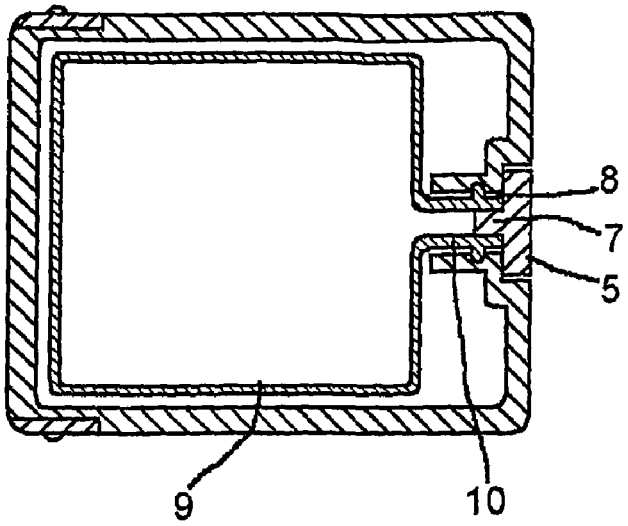
FIG. 4 is a schematic cross-section through the cosmetic compact along the line IV-IV in FIG. 3, shown when the lid is closed.

The liquid cosmetic product is contained in the container 9 that can be squeezed to expel the product through the orifice 8. Typical containers known in the art include a tubular container having collapsible walls. As shown in FIG. 4 the container 9 is a tottle substantially covering the entire floor area within the base 2. An upper side wall of the container is therefore exposed for application of finger pressure when the lid 2 of the compact 1 is opened. The container 9 has a neck 10 terminating adjacent to the stopper 5, to dispense the liquid cosmetic product. The dispensing orifice 8 may be provided in a wider filling plug (not shown) sealingly positioned within the neck 10. The container 9 is held in the base 3 of the cosmetic compact 1 by a snap-in arrangement 11 such that it can be detachably removed from the cosmetic compact 1 when empty, or to substitute one liquid cosmetic product for another. The snap-in arrangement 11 comprises a circumferential ridge 11*a* on the neck of the container. The ridge 11*a* snaps into an internal recess in a collar 11*b*, integrally moulded with or fixed to the base 3 adjacent the stopper 5. Many other means to secure the container 9 in the base 3 of the cosmetic compact 1 known in the art are permissible. For example, the container may be held in or beneath a secondary housing or cover which fits in the recess in the base 3 of the cosmetic compact 1 by a snap-in arrangement. A finger access hole may be provided, allowing the upper wall of the container 9 to be squeezed to dispense the cosmetic material.

Alternatively, the container 9 may be permanently held in the base of the cosmetic compact or form part of the base. This simplifies the manufacturing process and hence further reduces costs of manufacture. For example the base 3 of the cosmetic compact 1 can be integrally moulded with the container 9 by way of insert moulding. Alternatively, the container 9 can be held in the base 3 by adhesive, ultrasonic welding, or the like. The entire compact may be disposed of and recycled when the container 9 is empty.

The lid 2 and the base 3 of the cosmetic compact 1 can be separately moulded from a single material, for example, injection moulded relatively rigid plastics resin. For ease of manufacture it is preferable that the stopper 5 is integrally moulded with the lid 2.

When the lid 2 is in the closed position as shown in FIG. 3, the stopper 5 is shown with its protrusion 7 inserted into the orifice 8 of the container 9 in the base 3 of the cosmetic compact 1. The lid 2 is opened by simply pivoting the stopper 5 about its hinge 6 such that the protrusion 7 is withdrawn from the orifice 8. The lid 2 is now able to rotate about the hinges 4 to the open position as shown in FIG. 2. The contents of the container 9 can then be dispensed by pressing on or squeezing the tottle. This causes the liquid cosmetic product to be expelled from the orifice 8. As well as squeezing the upper wall of the tottle 9, a finger hole 14 incorporated in the underside of the base of the cosmetic compact 1 provides a means to squeeze the tottle from underneath. A cosmetic applicator 13 such as a puff, sponge, etc can be stored in the cosmetic compact 1 above the container 9, as shown in FIGS. 2 and 3. In addition, a mirror 12 can attached to the underside of the lid 2 as shown in FIGS. 2 and 3.

An advantage of this arrangement over conventional cosmetic compacts for dispensing a liquid cosmetic product is the ability to open the lid of the cosmetic compact and the container holding the liquid cosmetic product without needing to provide a separate stopper or cap to the container; the whole being simple to manufacture, having few components. This further provides the ability to compactly combine liquid cosmetic product with an applicator used to apply the liquid product.

Figure 5:
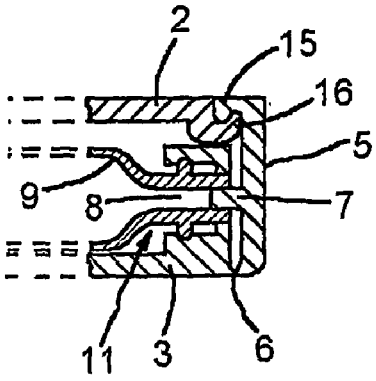
FIG. 5 is a scrap cross-section through an alternative stopper and latch for the compact lid.
Figure 6:
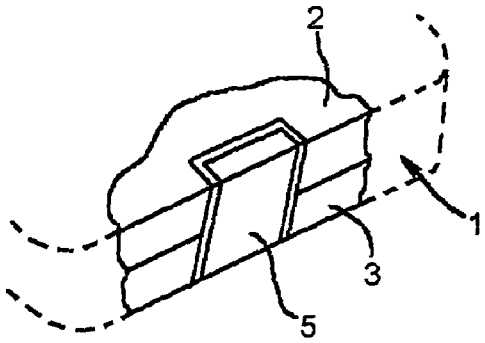
FIG. 6 is a scrap perspective view of the latch of FIG. 4.
Figure 7:
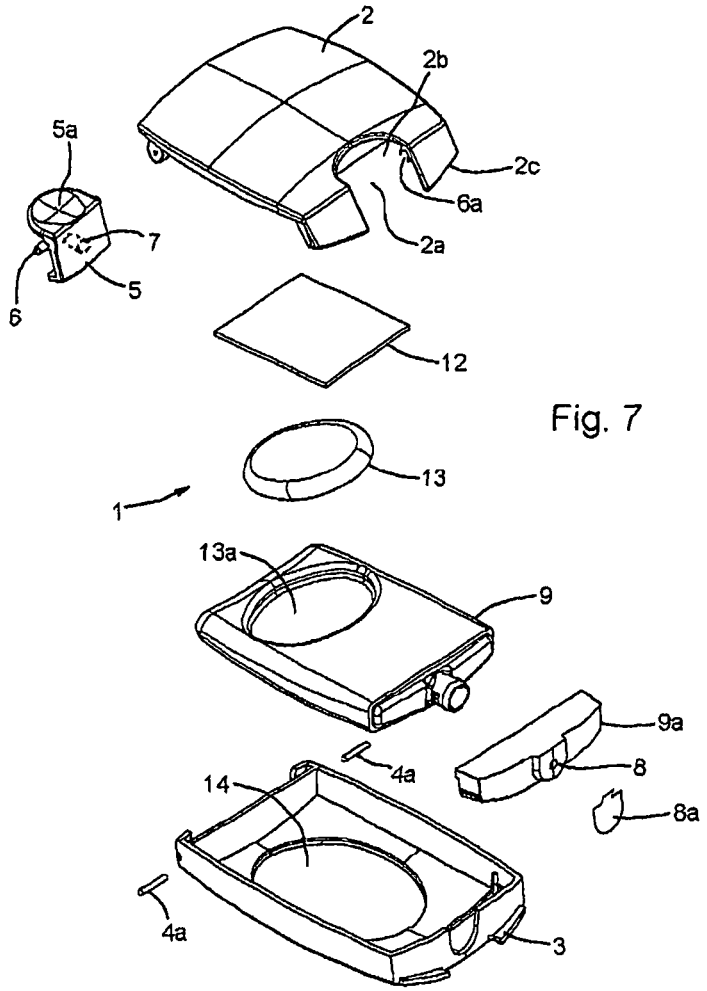
FIG. 7 is an exploded perspective view of a further embodiment of the invention.

The stopper 5 is not necessarily restricted to the lid 2 of the cosmetic compact 1 but can instead be attached to the base 3 as shown in FIGS. 5 and 6. Here the stopper 5 is integrally moulded with the base 3. The lower edge of the stopper 5 is hingedly attached to the base 3 by flexible web 6. The upper edge of the stopper 5 has a rearwardly and downwardly extending lip 15 which snap-engages with a complementary lip 16 formed on the lid 2. The lips 15, 16 co-operate to hold the lid 2 closed on the base 3 when the protrusion 7 is received in the orifice 8.

Figure 8:
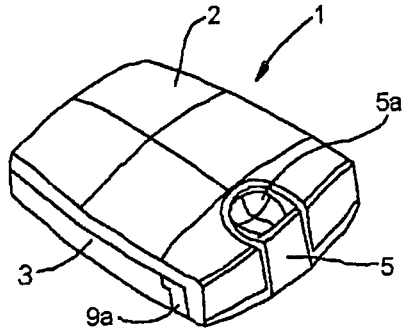
FIG. 8 is a perspective view corresponding to FIG. 7, of a fully assembled compact.

A further embodiment of the invention is shown in FIGS. 8 and 9. As shown, a compact 1 comprises a base 3 and a lid 2 hingedly connected to the base by a pair of hinge pins 4*a*. A tottle 9 having a closure cap 9*a* is removably installable in the base 3. Prior to such installation (e.g to allow the tottle to be supplied as a refill), a dispensing orifice 8 in the cap is covered by a peel-off film seal 8*a*. The tottle is formed with a depression 13*a* in its upper side for housing an applicator sponge 13. The base has an aperture 14 allowing finger access to the opposite (lower) side of the tottle, for squeezing out the contents. A mirror 12 is fixed to the inside of the lid 2. In this embodiment, a combined stopper and lid closure catch 5 is provided, having a lateral extension forming a rocker button 5*a*. The stopper/closure catch 5 is hingedly mounted to the lid by a pair of oppositely directed, integrally moulded pins 6 (only one visible in FIG. 1), snap-engageable in bearing receptacles 6*a* formed on the inside of the lid. When so mounted, the stopper/closure catch 5 is received in an aperture 2*a* formed in a front lip 2*c* depending from the lid. A continuation 2*b* of the aperture 2*a* extends into the lid top surface and is occupied by the rocker button 5*a*. With the lid 2 closed, a stopper protrusion 7 formed on the inside of the stopper/closure catch 5 can be pressed into the dispensing orifice 8 to seal it. This also serves to hold the lid 2 closed on the base 3. Pressing on the rocker button 5*a* causes the stopper/closure catch to rotate about the hinge pins 4*a*. This withdraws the protrusion 7 from the orifice 8, allowing the lid to be opened and cosmetic material to be dispensed from the tottle.

The invention claimed is:

1. A cosmetic compact comprising a lid hingedly connected to a base, the compact further comprising a container to hold liquid cosmetics, the lid being rotatable relative to the base from an open position to a closed position to house the container, and a stopper for the container connected to the lid or the base, the stopper comprising a protrusion that cooperates directly within a dispensing orifice in the container, wherein the connection between the stopper and the lid or the base comprises a further hinge, wherein the lid covers the entire container when the lid is closed against the base, and wherein the lid is opened by pivoting the stopper about the further hinge such that the stopper is withdrawn from the dispensing orifice which allows the lid to be rotated to an open position, and wherein the lid is latched closed against the base by inserting the stopper directly into the dispensing orifice; the container comprises a flexible wall which is accessible when the lid of the compact is opened, and the container comprises a further flexible wall which is accessible through an aperture in the base of the compact.

2. The cosmetic compact as claimed in claim 1, in which the further hinge comprises a web.

3. The cosmetic compact as claimed in claim 2, in which the web is integrally formed with the stopper and an adjacent part of the compact.

4. The cosmetic compact as claimed in claim 1, in which the further hinge comprises a pin or protrusion connecting the stopper to the lid/base.

5. The cosmetic compact as claimed in claim 1, in which the container is tubular.

6. The cosmetic compact as claimed in claim 1, in which the container is a squeeze-to-empty container.

7. The cosmetic compact as claimed in claim 6, in which the container is a tottle.

8. The cosmetic compact as claimed in claim 1, in which the container is removably attached to the base of the compact.

9. The cosmetic compact as claimed in claim 1, wherein the stopper further comprises a rocker button such that pressure applied to the rocker button when the lid is closed against the base of the compact causes the stopper to rotate about the further hinge so as to withdraw a protrusion of the stopper from the dispensing orifice.

10. The cosmetic compact as claimed in claim 1, further comprising a liquid cosmetic, wherein the lid of the cosmetic compact is opened in use in order to allow a user to apply pressure to the container holding the liquid cosmetic for dispensing the liquid cosmetic.

* * * * *